US010195874B2

(12) United States Patent
Barry et al.

(10) Patent No.: US 10,195,874 B2
(45) Date of Patent: Feb. 5, 2019

(54) INERT UV INKJET PRINTING HAVING DUAL CURING MODES FOR ULTRAVIOLET-CURABLE INK

(71) Applicant: ELECTRONICS FOR IMAGING, INC., Fremont, CA (US)

(72) Inventors: Jonathan Barry, Meredith, NH (US); John Duffield, Meredith, NH (US); Lianhui Cong, Concord, NH (US); Arthur L. Cleary, Fort Myers, FL (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 15/730,062

(22) Filed: Oct. 11, 2017

(65) Prior Publication Data

US 2018/0029383 A1 Feb. 1, 2018

Related U.S. Application Data

(63) Continuation of application No. 12/423,700, filed on Apr. 14, 2009.

(51) Int. Cl.
*B41J 11/00* (2006.01)

(52) U.S. Cl.
CPC ..... *B41J 11/002* (2013.01)

(58) Field of Classification Search
CPC ..... B41J 11/00; B41J 11/002
See application file for complete search history.

(56) References Cited

U.S. PATENT DOCUMENTS

| | | | |
|---|---|---|---|
| 2,927,502 | A | 3/1960 | Watrous et al. |
| 4,326,001 | A | 4/1982 | Sachs et al. |
| 4,857,086 | A | 8/1989 | Kawai |
| 4,952,973 | A | 8/1990 | Jones et al. |
| 5,099,256 | A | 3/1992 | Anderson et al. |
| 5,267,005 | A | 11/1993 | Yamamoto et al. |
| 5,284,506 | A | 2/1994 | Barbe et al. |
| 5,294,946 | A | 3/1994 | Gandy et al. |
| 5,792,296 | A | 8/1998 | Soltysiak |
| 6,126,095 | A | 10/2000 | Matheson et al. |
| 6,154,232 | A | 11/2000 | Hickman et al. |
| 6,335,140 | B1 | 1/2002 | Miyazaki |
| 6,461,064 | B1 | 10/2002 | Leonard et al. |
| 6,522,349 | B1 | 2/2003 | Lee |
| 6,550,905 | B1 | 4/2003 | Deckers et al. |

(Continued)

FOREIGN PATENT DOCUMENTS

| | | | |
|---|---|---|---|
| CN | 1606604 | A | 4/2005 |
| CN | 1817811 | A | 8/2006 |

(Continued)

OTHER PUBLICATIONS

Jack, K , "UV Curing Technology", Label & Narrow Web,retrieved on Oct. 14, 2010 from urL: http://www.labelandnarrowweb.com/articles/2009/03/uv-curing technology, Mar. 2009, 4.

*Primary Examiner* — Andrew Jordan
(74) *Attorney, Agent, or Firm* — Perkins Coie LLP

(57) ABSTRACT

Enhanced printing solutions are enabled by providing ultraviolet curing conditions without requiring complete evacuation of atmospheric oxygen. Increased ink coverage and adjusted surface appearance are also provided.

20 Claims, 10 Drawing Sheets

(56) References Cited

U.S. PATENT DOCUMENTS 6,550,906 B2 4/2003 Ylitalo et al.
6,554,414 B2 4/2003 Ylitalo et al.
6,593,390 B1 7/2003 Johnson et al.
6,598,531 B2 7/2003 Farkas et al.
6,683,421 B1 1/2004 Kennedy et al.
6,736,918 B1 5/2004 Ichikawa et al.
6,789,873 B2 9/2004 Booth et al.
6,927,014 B1 8/2005 Figov
7,278,728 B2 10/2007 Desie et al.
7,374,977 B2 * 5/2008 Yamazaki ..... G02F 1/136286 257/E21.166
7,419,716 B2 9/2008 Tian et al.
7,419,718 B2 * 9/2008 Ogata ..... B01J 21/063 428/323
7,431,897 B2 10/2008 Hahne et al.
7,520,601 B2 4/2009 Claes et al.
7,909,453 B2 * 3/2011 Noro ..... B41J 2/15 347/102
7,951,726 B2 * 5/2011 Kim ..... H01L 51/448 257/E21.242
7,988,280 B2 * 8/2011 Noro ..... B41J 2/15 347/102
8,186,801 B2 5/2012 Saita et al.
8,567,936 B2 * 10/2013 Edwards ..... B41J 15/165 347/102
9,102,171 B2 * 8/2015 Veis ..... B41J 11/002
9,259,943 B2 * 2/2016 Veis ..... B41J 11/002
9,487,010 B2 * 11/2016 Tennis ..... B41J 2/175
9,527,307 B2 * 12/2016 Edwards ..... B41J 11/002
9,676,209 B2 * 6/2017 Veis ..... B41J 11/0015
2001/0052924 A1 12/2001 Steinke et al.
2002/0071000 A1 6/2002 Rezanka et al.
2002/0119395 A1 8/2002 Kramer et al.
2002/0122106 A1 9/2002 Ylitalo
2002/0149659 A1 10/2002 Wu et al.
2002/0166470 A1 11/2002 Nedblake, Jr. et al.
2002/0175984 A1 11/2002 Ylitalo et al.
2003/0128250 A1 7/2003 Booth
2003/0164571 A1 9/2003 Crump et al.
2003/0202082 A1 10/2003 Takabayashi et al.
2003/0227527 A1 12/2003 Richards et al.
2004/0029030 A1 2/2004 Murray
2004/0166249 A1 8/2004 Siegel
2006/0066703 A1 3/2006 Kadomatsu et al.
2006/0066704 A1 3/2006 Nishida et al.
2006/0075914 A1 4/2006 Kawano
2006/0119686 A1 6/2006 Odell
2006/0158473 A1 7/2006 Mills et al.
2006/0182937 A1 8/2006 Tsuchimura
2006/0197787 A1 9/2006 Kusunoki et al.
2006/0221161 A1 10/2006 Hori et al.
2007/0013757 A1 1/2007 Ohnishi
2007/0040885 A1 2/2007 Kusunoki
2007/0058020 A1 3/2007 Wetjens et al.
2007/0115335 A1 5/2007 Vosahlo et al.
2007/0120930 A1 5/2007 Domoto et al.
2007/0154823 A1 7/2007 Marson et al.
2007/0171263 A1 7/2007 Inoue et al.
2007/0184141 A1 8/2007 Custer et al.
2007/0278422 A1 12/2007 Einhorn et al.
2007/0296790 A1 12/2007 Nakazawa et al.
2008/0012887 A1 * 1/2008 Maeno ..... B41J 2/2114 347/9
2008/0015278 A1 1/2008 Malik et al.
2008/0018682 A1 1/2008 Spehrley et al.
2008/0024548 A1 1/2008 Shang et al.
2008/0156506 A1 7/2008 Wagner
2008/0158278 A1 7/2008 Inoue
2008/0192075 A1 8/2008 Campion et al.
2008/0192100 A1 8/2008 Nakajima et al.
2008/0199230 A1 8/2008 Kawano
2008/0218574 A1 9/2008 Furuno et al.
2009/0085996 A1 4/2009 Kasai
2009/0086000 A1 4/2009 Yokota et al.
2009/0122126 A1 5/2009 Ray et al.
2009/0207223 A1 8/2009 Cofler et al.
2009/0207224 A1 8/2009 Cofler
2009/0244165 A1 10/2009 Saita
2009/0246382 A1 10/2009 Hirato et al.
2009/0251520 A1 * 10/2009 Noro ..... B41J 2/15 347/102
2010/0080924 A1 4/2010 Leng
2010/0177151 A1 7/2010 Thompson et al.
2010/0208020 A1 8/2010 Matsumoto
2010/0259589 A1 10/2010 Barry et al.
2010/0309269 A1 12/2010 Vosahlo et al.
2011/0122596 A1 5/2011 Miyazaki et al.
2011/0134199 A1 * 6/2011 Noro ..... B41J 2/15 347/102
2012/0113199 A1 5/2012 Edwards
2013/0100216 A1 4/2013 Ohnishi
2013/0113868 A1 * 5/2013 Veis ..... B41J 11/0015 347/102
2014/0063854 A1 * 3/2014 Park ..... G02B 6/0065 362/619
2018/0029383 A1 * 2/2018 Barry ..... B41J 11/002

FOREIGN PATENT DOCUMENTS

CN 101291999 A 10/2008
EP 0585160 8/1993
EP 1484370 A1 12/2004
EP 1913979 A1 4/2008
EP 2042335 A2 4/2009
GB 2349607 A 11/2000
JP 62280801 A 12/1987
JP 62280804 A 12/1987
JP 01-265204 10/1989
JP 01-270002 10/1989
JP 01-270003 10/1989
JP 01-279205 11/1989
JP 07031831 B 4/1995
JP 2000-211244 8/2000
JP 2004516963 6/2004
JP 2004-306589 11/2004
JP 2006110895 A 4/2006
JP 2008087272 A 4/2008
JP 2008183820 A 8/2008
JP 2009083267 4/2009
JP 2010000742 1/2010
JP 2010069682 4/2010
JP 2010241119 A 10/2010
JP 2010269574 12/2010
WO 02053383 A2 7/2002
WO 2003103970 12/2003
WO 2008001051 1/2008

* cited by examiner

INERT UV INKJET PRINTING HAVING DUAL CURING MODES FOR ULTRAVIOLET-CURABLE INK

CROSS-REFERENCE TO RELATED APPLICATIONS

This application is a continuation of the U.S. utility patent application Ser. No. 12/423,700 filed on Apr. 14, 2009, which is incorporated herein by this reference in its entirety.

BACKGROUND OF THE INVENTION

Technical Field

The invention relates to the field of inkjet printing. More specifically, the invention relates to techniques for more efficient curing of ultraviolet curable ink deposited in a printing environment.

Description of the Related Art

Ultraviolet curing of liquid chemical formulations has been an established practice for many years. In ultraviolet curing, a liquid chemical formulation comprising photoinitiators, monomers and oligomers, and possibly pigments and other additives is exposed to ultraviolet light, thereby converting the liquid chemical formulation into a solid state.

Ultraviolet-curable inks are oftentimes used advantageously in the field of ultraviolet inkjet printing. In these applications, ultraviolet-curable ink is jetted from a print head onto a substrate to form a portion of an image. Typically the print head scans back and forth across a width of the substrate, while the substrate steps forward for progressive scan passes. Thus a relatively small print head is used to build a very large image.

In some cases of ultraviolet inkjet printing, an ultraviolet light source is mounted on either side of a print head to cure the ink. Using this configuration, ultraviolet-curable ink can be jetted and cured in the same print head pass. Other times, the ink is jetted in one pass and cured in a subsequent print head pass.

In some cases of ultraviolet inkjet printing, the width of the print head is at least equal to that of the substrate and the entire image is formed with a single pass of the substrate underneath the print head. In these cases, the ultraviolet light source is typically in a fixed location, with the substrate moving under the print head first and subsequently under the ultraviolet light source.

As explained above, curing ink involves directing photons, typically with wavelengths in the ultraviolet spectrum, onto an ink deposit. The photons interact with photoinitiators present within the ink, creating free radicals. The created free radicals initiate and propagate polymerization (cure) of the monomers and oligomers within the ink. This chain reaction results in the ink curing to a polymer solid. However, the presence of oxygen at the ink surface inhibits such a chain reaction from occurring within the ink. This is often referred to as oxygen inhibition.

In normal ultraviolet curing in an air environment, a high amount of ultraviolet energy and/or a high concentration of photoinitiator are needed to achieve a full cure, compared to the ultraviolet power and photoinitiator concentration required in an oxygen free curing environment. Indeed, both higher ultraviolet energy and higher photoinitiator concentration deleteriously affect the final film properties, and increase ink and printer costs.

Common solutions for providing less reactive curing include completely supplanting atmospheric oxygen with a less reactive gas such as nitrogen in the cure zone. For example, U.S. Pat. No. 6,126,095 to Matheson et al., entitled "Ultraviolet Curing Apparatus Using an Inert Atmosphere Chamber" teaches a curing apparatus comprising a curing chamber for accommodating a controlled atmosphere. The curing chamber includes inlets and nozzle assemblies for supplying less reactive gas into the chamber and maintaining a less reactive atmosphere therein.

Likewise, U.S. Pat. No. 7,431,897 to Hahne et al., entitled "Apparatus Replacing Atmospheric Oxygen with an Inert Gas from a Laminar Air Boundary Layer and Application of Said Apparatus" (hereinafter referred to as "Hahne") teaches completely replacing atmospheric oxygen with a less reactive gas.

These prior art references disclose specialized and expensive approaches to providing reduced oxygen curing conditions, but fall short of achieving feasibility for common inkjet printing systems, because it remains difficult and expensive to supply the printing environments with enough inerting gas to effectively rid the curing region of oxygen. It would be desirable to address this shortcoming.

Additionally, ultraviolet ink has a significant cost associated with it. Therefore, thicker films of ultraviolet-curable ink increase the cost of the finished image. It is oftentimes desirable to lay down as thin a film of ink as possible without compromising color strength. In typical ultraviolet inkjet printing applications, there is a small time delay before a jetted droplet of ink is exposed to the ultraviolet light source. In that time delay, sometimes known as "time to lamp," the drop generally tends to spread out and wet the media. This phenomenon is known as "dot gain." Longer time to lamp results in higher dot gain and thinner final ink layer thickness. However, longer times to lamp also tend to increase the size of the print head or printer, and decrease the overall print speed. It would be desirable to address this problem as well.

In scanning printer applications, droplets of ink are laid down then cured. Then additional drops are jetted onto the cured drops. This method tends to create a coarse surface finish, i.e. a matte finish, which reduces the glossiness of the image. In many applications, a high gloss finish is desirable in the final appearance of the print job. However, in some applications, it may be desirable to vary the level of gloss/matte or surface appearance. Current inkjet printing does not allow for such variations in surface appearance. It would be desirable to address these issues as well.

SUMMARY OF THE INVENTION

In view of the foregoing, the invention provides enhanced printing solutions by providing ultraviolet curing regions without requiring the introduction of less reactive gas while also increasing ink coverage and adjusting surface appearance.

In some embodiments of the invention, one or more ultraviolet light source and a means for providing a reduced oxygen curing region are used to cure ink. In some embodiments of the invention, an apparatus with a reduced oxygen curing region is used in conjunction with common inkjet printing systems.

In some embodiments of the invention, a reduced oxygen curing region is created by depositing ultraviolet curable ink on a substrate; depositing a barrier over the resulting ink droplets in the curing region; exposing the curing region to ultraviolet radiation; and removing the barrier from the cured ink.

In some embodiments of the invention, a print carriage has one or more attached film canisters. The carriage contains print heads, which deposit ink droplets onto a substrate as they traverse the substrate. The film canisters lay down an atmospheric-barrier film onto the ink droplets as the carriage continues to traverse the substrate, thus creating a reduced oxygen curing region around the ink droplets. The carriage is also coupled to an ultraviolet light source that trails the motion of the carriage. As such, the covered ink is subsequently cured as the UV light source passes over the film-covered droplets. As the carriage continues its movement, the atmospheric-barrier film is removed; leaving only cured, and flattened ink on the substrate.

In some embodiments of the invention, a barrier to atmospheric oxygen is applied to ink droplets with an associated force. According to these embodiments, this force spreads out the ink droplet, thus increasing ink coverage. In some embodiments, the force smoothes out peaks and valleys between neighboring ink droplets, thus altering the surface appearance of the printed substrate. In some embodiments wicking between the substrate and the barrier film also causes the ink drop to spread out.

In some embodiments of the invention, a carriage containing print heads is coupled to one or more ultraviolet lights. The ultraviolet light is coupled to a roller that is substantially transparent to ultraviolet light. In some embodiments the roller is a substantially rigid rolling rod. The rolling rod is configured to make substantial contact with the substrate as the carriage traverses the substrate. According to these embodiments, the rolling rod trails the carriage and rolls over deposited ink laid down by the print heads, thus creating a momentarily oxygen free cure zone at the contact area beneath the roller. The ultraviolet light is directed on the ink beneath the rolling rod at this moment for curing the ink.

In other embodiments, the roller is substantially flexible and spreads out over the ink as it makes contact with the substrate. According to these embodiments, the reduced oxygen curing region is larger and easier to expose to adequate ultraviolet light. In some embodiments, a film-barrier on a roller guide replaces the roller to provide an even larger contact surface area between the film and the substrate.

Some embodiments of the invention involve other methods of providing a reduced oxygen curing region. According to these methods, the process begins with depositing ultraviolet curable ink on a moving ultraviolet-transparent film. The film is then rotated, causing contact to be made at a contact point between the deposited ink and a substrate. This contact point is exposed to ultraviolet radiation, thus transferring the ink to the substrate, and substantially simultaneously curing the ink. Finally, the ultraviolet-transparent film is rotated further, thus removing the film from the contact point and leaving a cured ink deposit on the substrate.

In some other embodiments, a carriage assembly is disclosed that includes one or more inkjet print heads, and an atmospheric-barrier film system that surrounds an ultraviolet light source. The print heads deposit ink onto the film, which rotates around the light source as the carriage assembly traverses a substrate. When the deposited ink makes contact with the substrate the light source exposes the deposited ink with ultraviolet radiation, thus curing the ink and transferring it to the substrate.

In some embodiments of the invention a printing system includes a reduced oxygen curing region using an atmospheric-barrier film, and incorporating less reactive gas introduction. In some embodiments, the curing region comprises a roller system for the application of an atmospheric-barrier film to a substrate, and also a less reactive gas introduction means. In some embodiments, the roller system is disposed at an angle to the surface of the curing region, thus forming a pocket. The less reactive gas introduction means is configured to deliver less reactive gas into the pocket. As explained above, a substrate is fed through the printing region, and ultraviolet-curable ink is deposited onto the substrate. The substrate is then fed into the curing region, thereby encountering the less reactive gas. Subsequently, the substrate makes contact with the atmospheric-barrier film. The less-reactive gas and the atmospheric-barrier film work synergistically to reduce the possibility of oxygen reacting with the ink during curing.

DETAILED DESCRIPTION OF THE INVENTION

Figure 1:
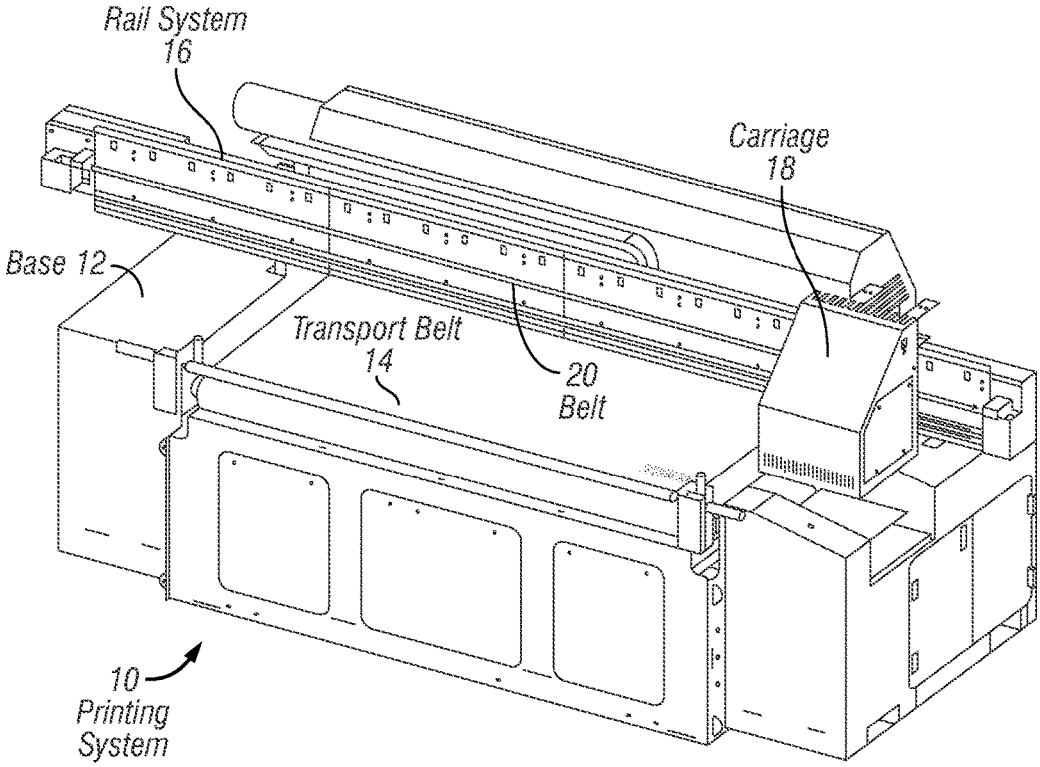
FIG. 1 (Prior Art)
FIG. 1 illustrates an isometric view of a common printing system adapted for printing images on a variety of substrates.

Systems and methods are provided for curing ink, using one or more ultraviolet light sources and a means for providing a reduced oxygen curing region. The means for providing a reduced oxygen curing region can be adapted for use with a common printing system. FIG. 1 is an isometric view of a common printing system 10, adapted for printing images on a variety of substrates. The printing system 10 includes a base 12, a transport belt 14 which moves the substrate through the printing system, a rail system 16 attached to the base 12, and a carriage 18 coupled to the rail system 16. The carriage 18 holds a series of inkjet print heads (not shown) and is attached to a belt 20 which wraps around a pair of pulleys (not shown) positioned on either end of the rail system 16. A carriage motor is coupled to one of the pulleys and rotates the pulley during the printing process. As such, when the carriage motor causes the pulley to rotate, the carriage moves linearly back and forth along the rail system 16.

As the substrate moves through the system 10, the inkjet print heads deposit ink onto the substrate. The carriage 18 moves along the rail system 16, depositing ink on the substrate as it traverses the rail system 16. Upon the completion of a traversal, the substrate steps ahead by movement of the transport belt 14 to position the substrate for a return traversal and subsequent ink deposit. In some embodiments, the carriage passes over the same area multiple times, laying down swaths of image pixels each time, building an image consecutively.

In some other embodiments of the invention, a fixed group of print heads spans the width of the substrate and remains fixed as the substrate transport system moves a substrate beneath the print heads.

In either case, when ultraviolet curable ink is used, it is desirable to cure the ink shortly after being deposited.

Process for Ultraviolet Curing in a Less Reactive Environment

Figure 2:
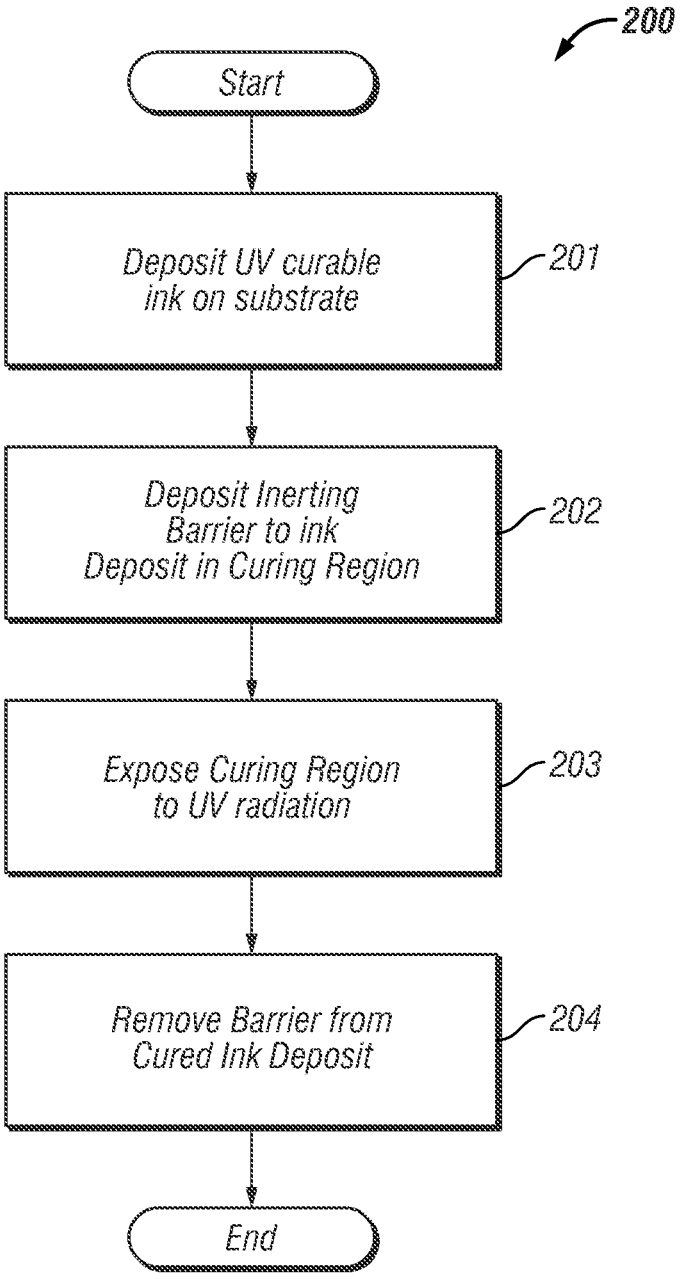
FIG. 2 illustrates an exemplary process for ultraviolet curing of deposited ink according to some embodiments of the invention.

FIG. 2 illustrates an exemplary process 200 for ultraviolet curing of deposited ink in an inkjet printing system, according to some embodiments of the invention. The process begins with depositing ultraviolet-curable ink on a substrate 201. In some embodiments of the invention, the ultraviolet-curable ink is deposited using a scanning print head configuration as disclosed in FIG. 1. Next, a barrier film is physically placed on the ultraviolet-curable ink deposit 202 in a curing region. Various means for placing a barrier film on the ink deposit are disclosed below. In some embodiments of the invention, the atmospheric-barrier film is substantially transparent to at least a portion of the ultraviolet spectrum of light.

In some embodiments of the invention, the barrier film accomplishes supplementary goals in addition to eliminating oxygen from the curing area of the ink. For example, in some embodiments, a barrier film is applied to the deposited ultraviolet ink with pressure to cause positive dot gain (as explained in more detail below). In some embodiments wicking between the substrate and the barrier film also causes positive dot gain. In some embodiments, the barrier film affects the surface appearance of cured ink (as explained also in more detail below).

The process 200 continues as an ultraviolet light source is directed onto the ink deposit through the barrier film, exposing photoinitiators to ultraviolet radiation 203, thus curing the ink. Finally, the process 200 terminates as the barrier is removed from the cured ink 204.

The process 200 disclosed above effectively removes oxygen from the curing region of a printing system as an ultraviolet-curable ink is deposited on to a substrate. Removing oxygen from the curing region allows a lower power ultraviolet light source to be used. Indeed, in some embodiments of the invention, the power of the ultraviolet light source may be reduced by approximately ninety percent using the methods disclosed herein. In some embodiments, removing atmospheric oxygen from the curing region allows less photoinitiator to be used in the ink. Ultraviolet power reduction and the reduction of the photoinitiator concentration increases efficiency and reduces cost. For example, in some embodiments of the invention, an ultraviolet light-emitting diode is used for a light source. Various means for providing an atmospheric-barrier to the curing region exist and are disclosed in more detail below.

Atmospheric-Barrier Film

Figure 3:
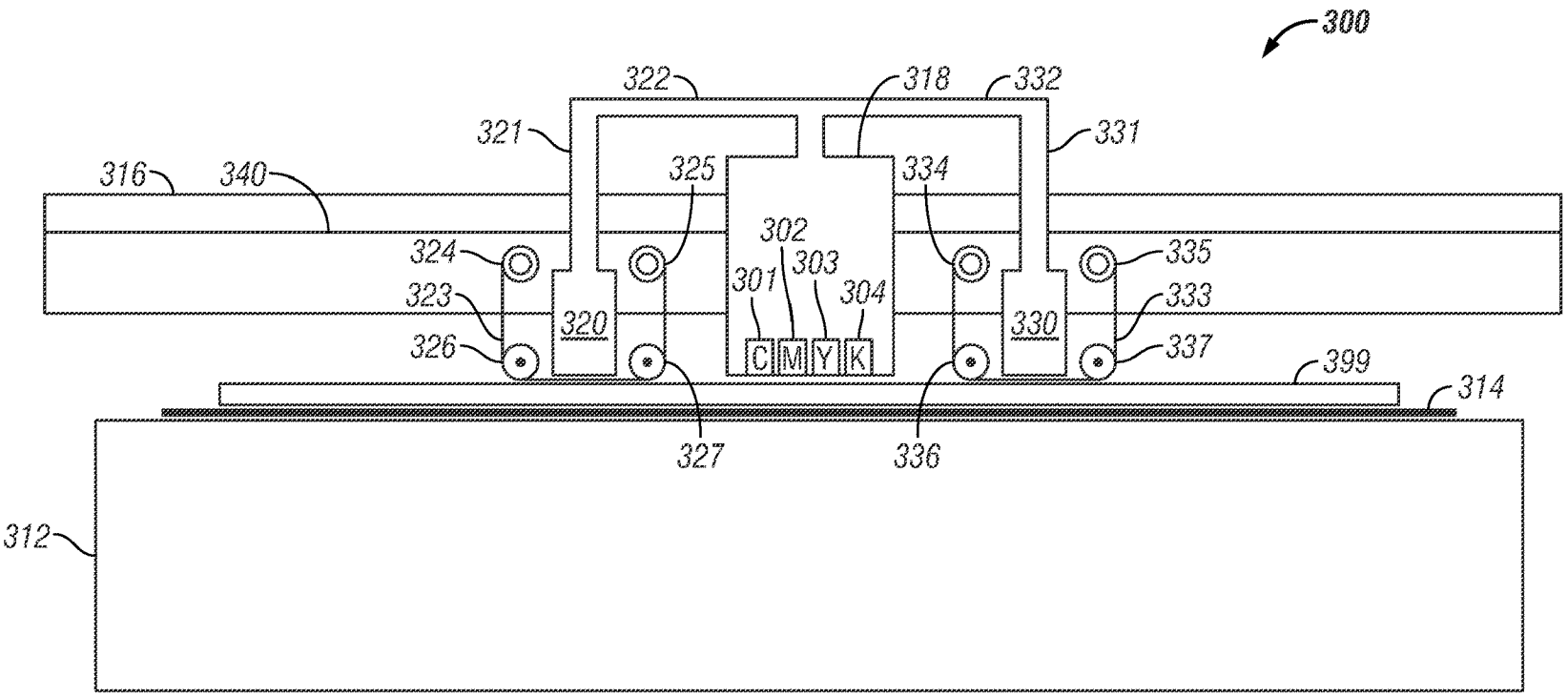
FIG. 3 illustrates a schematic representation of a printer using film barriers for providing the reduced oxygen curing region for ultraviolet curable inkjet printing applications, according to some embodiments of the invention.

FIG. 3 illustrates a schematic representation of a printer 300 using atmospheric-barrier films for providing a reduced oxygen curing region in ultraviolet curable inkjet printing applications according to some embodiments of the invention.

According to FIG. 3, a carriage 318 containing print heads 301, 302, 303, and 304 is coupled to a printer 300. The carriage 318 is coupled to the base 312 of the printer 300 via the rail system 316. The rail system 316 includes a belt 340 for moving the carriage 318 back and forth across the base 312.

A transport belt 314 is disposed on a surface of the printer base 312 and a substrate 399 is arranged between the carriage 318 and the transport belt 314. In operation, the transport belt 314 steps forward and/or backward, thus moving the substrate 399 in and/or out of the page.

The carriage 318 is also coupled to the ultraviolet light sources 320 and 330 with arms 321, 322, 331, and 332. The ultraviolet light sources 320, 330 are enveloped by films 323 and 333. The films 323, 333 are wound between film canisters 324, 325 and film canisters 334, 335, respectively. Furthermore, a lower portion of the films 323, 333 are held substantially parallel with the substrate 399 by application roller guides 326, 327, 336, 337. As such, the films 323, 333 are disposed in near or actual contact with, and substantially parallel to the plane of the substrate 399.

The films 323 and 333 are substantially transparent to at least a portion of the ultraviolet spectrum of light. In other embodiments of the invention, the films 323 and 333 are polyethylene. In some embodiments of the invention, the films 323 and 333 are polyester. It will be readily apparent to those with ordinary skill in the relevant art having the benefit of this disclosure that in other embodiments, any suitable film can be used that is substantially transparent to at least part of the ultraviolet spectrum.

For the purpose of simple viewing, the film canisters 324, 325, 334, 335 and the application roller guides 326, 327, 336, 337 are shown without a means for coupling with the arms 321, 331 and/or the ultraviolet light sources 320, 330. However, it will be clear to those with ordinary skill in the art having the benefit of this disclosure that a variety of coupling means can be used to accomplish this goal, such as arms coupling the axis of the canisters 324, 325, 334, and 335 and guides 326, 327, 336, and 337 to the arms 321 and 331.

In some embodiments of the invention, the carriage 318 moves back and forth across the base 312 to deposit ink onto the substrate 399. According to these embodiments, the film canisters 324, 325, 334 and 335 contain an extra supply of film. As the carriage 318 traverses the base 312 the film canisters 324, 325, 334 and 335 either let out extra film or intake excess film such that the film shared by canisters 324 and 325 and canisters 334 and 335 is long enough to cover the entire width of the substrate 399. The rate at which the canisters 324, 325, 334 and 335 let out and take in film is driven by the roller guides 326, 327, 336, and 337. This rate is synchronized with the speed of the carriage 318 traversing the substrate 399.

According to these embodiments, as the carriage 318 traverses from the left limit of the rail system 316 to the right limit of the rail system 316, the film canisters 325 and 335 let out excess film, while the film canisters 324 and 334 intake excess film. As such, a new portion of film is continuously rolling under the trailing roller guide 327 and roller guide 337. Likewise, as the carriage traverses from the right limit of the rail system 316 to the left limit of the rail system 316, the film canisters 324 and 334 let out excess film, while the film canisters 325 and 335 intake excess film. As such, a new portion of film is continuously rolling under the trailing roller guide 336 and roller guide 326.

In some other embodiments of the invention, the arms 322 and 332 are configured to raise and lower. According to these embodiments, the unused film canisters and the roller guides (those not trailing the motion of the carriage) are lifted when preceding the motion of the carriage 318, and thus do not contact the substrate 399.

As the carriage 318 traverses the substrate 399, the print heads 301, 302, 303, 304 deposit ultraviolet-curable ink onto the substrate 399 as ink droplets (not shown). Shortly after the ink droplets are deposited, film 323, 333 is guided under the roller guide trailing the carriage (either 327 or 336, depending on the direction of motion). The roller guide (either 327 or 336, depending on the direction of motion) encounters and passes over an ink droplet. As the roller guide (327 or 336) passes over an ink droplet, it applies pressure to the film (323 or 333) and the ink droplet, effectively depositing the film (323 or 333) onto the droplet. Since the film (323 or 333) is continuously moving between the film canisters 324, 325 and 334, 335, and its rate corresponds with that of the roller guide (327 or 336), it does not tend to drag or plow the ink droplet. As the films 323 and 333 are deposited on ink droplets, the droplets are isolated from atmospheric elements, such as oxygen.

After the film is deposited onto the ink droplets, the carriage 318 continues in its motion. Soon after, the ultraviolet light source (320 or 330) moves over the film-covered ink droplets. The ultraviolet light source (320 or 330) shines ultraviolet radiation on the film-covered ink droplets, thus curing the ink. Due to the presence of the film, the ultraviolet light sources 320, 330 require less power and the ink requires less photoinitiator, as compared to techniques that do not use film in this manner.

The carriage 318 continues its motion along the rail system 316 as the ink droplets are cured with the ultraviolet light source (320 or 330). The next roller guide (326 or 337, depending on the direction of motion) then encounters the film-covered and cured ink droplets. As the roller guide 326, 337 passes over the cured droplets, the film 323 or 333 is directed up toward the film canister 324 or 335, thus removing the film 323 or 333 from the cured ink droplet. The ink is cured to the extent that it does not stick to the film 323 or 333.

Surface Feature Alteration

The system disclosed by FIG. 3 uses rollers to direct a film over ink droplets and apply pressure to the film. A direct effect of this manner of depositing film onto an ink droplet is to provide a reduced oxygen curing region. However, other advantages for the printing process are also achieved including altering the surface features of the ink.

Finish on printed substrate can range from a matte finish to a high-gloss finish as desired. Matte finishes are a result of an uneven surface texture in which the ink has valleys and peaks, while high-gloss finishes have a smooth surface texture. Inkjet printing typically results in a printed substrate having a matte finish because it necessarily involves depositing a series of ink droplets, thus forming peaks and valleys. According to some embodiments of the invention, the deposition of a smooth film and pressure on ink droplets deposited by an inkjet print head flattens out the surface of the ink, thereby resulting in a more glossy finish.

Figure 4A:
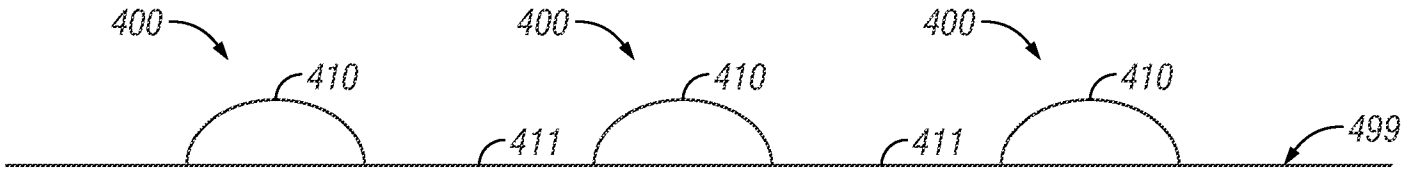
FIG. 4A illustrates a front view of a portion of substrate with ink droplets deposited thereon from an inkjet print head, according to some embodiments of the invention.
Figure 4B:
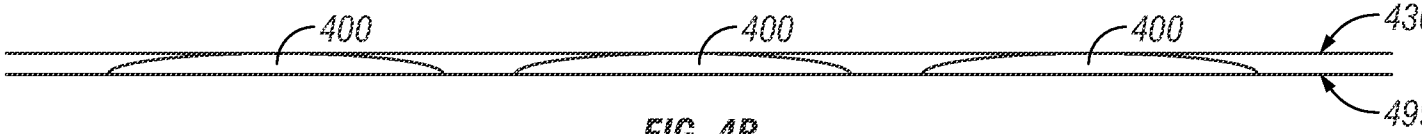
FIG. 4B illustrates a front view of the portion of substrate with ink droplets and a deposited film barrier layer, according to some embodiments of the invention.
Figure 4C:
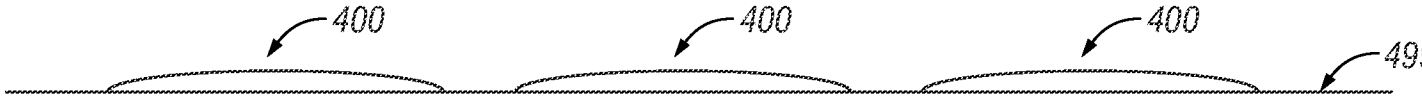
FIG. 4C illustrates a front view of a portion of a substrate with flattened and cured ink droplets, after removal of a film barrier layer, according to some embodiments of the invention.

FIGS. 4A through 4C illustrate how the process of applying a film to ink droplets can also provide a more high-gloss finish to the printed substrate, while also achieving the benefits of a reduced oxygen curing region. FIG. 4A illustrates a front view of a portion of substrate 499 with ink droplets 400 deposited thereon from an inkjet print head, according to some embodiments of the invention. The ink droplets 400 shown in FIG. 4A define discrete peaks 410 and valleys 411, which would normally result in a substrate 499 having a matte finish if cured.

FIG. 4B illustrates a front view of the same portion of substrate 499 with ink droplets 400 and an applied film layer 430 according to some embodiments of the invention. The film layer 430 is applied in a fashion consistent with this disclosure, and is preferably applied with pressure to the ink droplets 400. The application of pressure flattens and spreads the ink droplets 400. The ink droplets 400 are subsequently cured using ultraviolet radiation. Accordingly, any peaks or valleys present in FIG. 4B are much less apparent.

FIG. 4C illustrates a front view of the same portion of substrate 499 with flattened and cured ink droplets 400, after the film layer is removed. The ink droplets 400 are flattened and spread out, severely diminishing the distinctive peaks and valleys as shown in FIG. 4A. Accordingly, the substrate 499 gains a high-gloss finish.

Likewise, it will be readily apparent to those with ordinary skill in the relevant art, having the benefit of this disclosure, that a textured film can be used in place of the smooth film as disclosed above. Using a textured film will result in a matte finish by causing or increasing the size of the peaks and valleys between deposited ink droplets.

Dot Gain and Ink Coverage

As explained above, common inkjet printing applications involve jetting ink onto a substrate. These methods typically include a small time delay before the ink is exposed to the ultraviolet light source. In that time delay, sometimes known as "time to lamp," ink drops generally tend to spread out and wet the media. This phenomenon is known as "dot gain." Longer time to lamp results in higher dot gain and thinner final ink layer thickness. However, longer times to lamp will also tend to increase the size of the print head or printer, and decrease the overall print speed of the printer.

According to the present invention, the pressure applied to the ink droplets encourages ink to spread out, thereby increasing the coverage of deposited ink and reducing the amount of ink needed for the creation of an image. Increasing ink coverage in square meters per liter reduces the end cost of printing.

Other Configurations for Providing Less Reactive Curing

Figure 5:
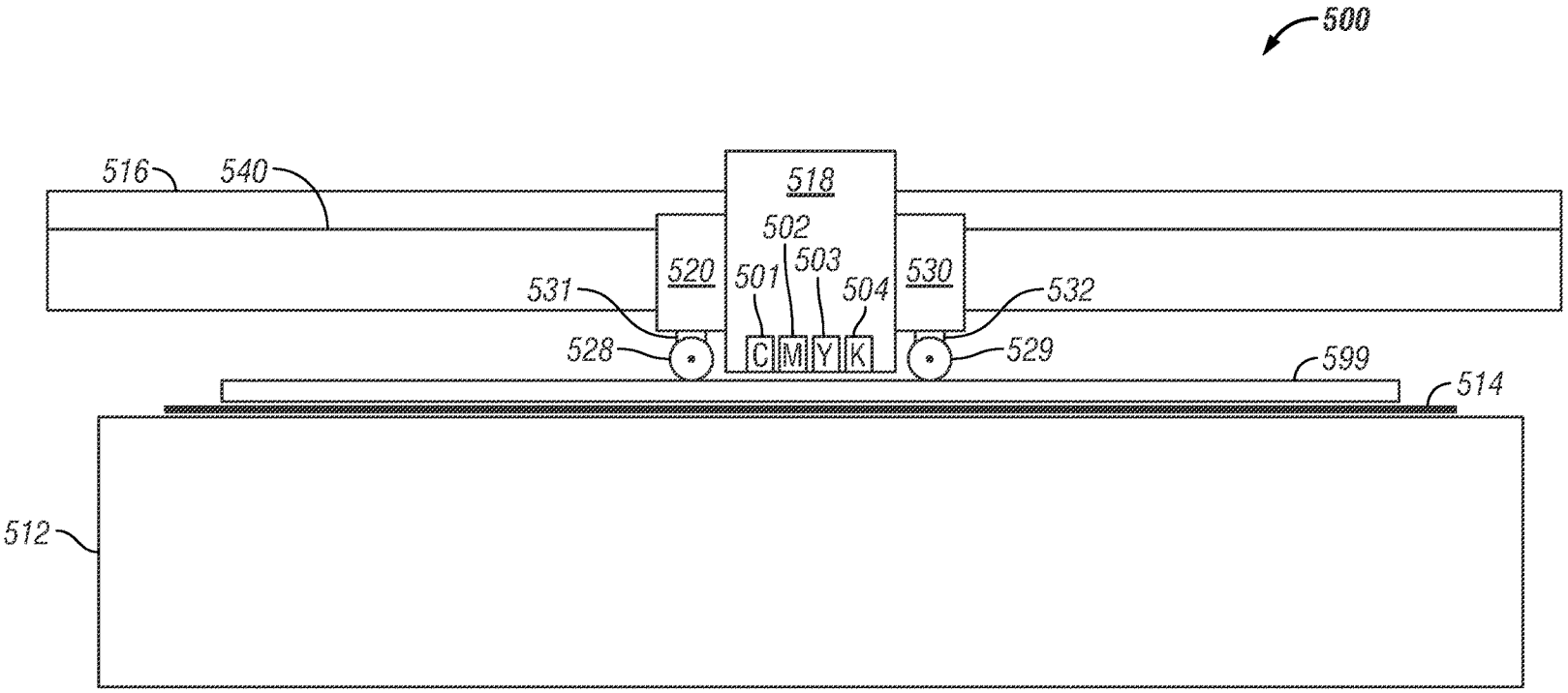
FIG. 5 is a front view of an alternative printing system using one or more rotating rods to provide a reduced oxygen curing region for inkjet printers, according to some embodiments of the invention.

As disclosed above, the deposition of an atmospheric-barrier film is effective for providing a reduced oxygen curing region to cure deposited ink. Various other configurations can also provide a less reactive curing region for inkjet printing applications. FIG. 5 is a front view of a printing system 500 using rotating rods 528, 529 to provide a reduced oxygen curing region for inkjet printers according to some embodiments of the invention. As illustrated in FIG. 5, a carriage 518 containing print heads 501, 502, 503, and 504 is coupled to a printer 500. The carriage 518 is coupled to the base 512 of the printer 500 via the rail system 516. The rail system 516 includes a belt 540 for moving the carriage 518 back and forth across the base 512.

A transport belt 514 is disposed on the surface of the base 512, and a substrate 599 is arranged between the carriage 518 and the transport belt 514. In operation, the transport belt 514 steps forward and/or backward, as explained above, thus moving the substrate 599 in and/or out of the page.

The carriage 518 is also coupled to ultraviolet light sources 520 and 530. The ultraviolet light sources 520 and 530 are coupled to arms 531 and 532, respectively. The arms 531 and 532 are coupled to the rotating rods 528 and 529 by a substantially axial member.

In some embodiments of the invention, the carriage 518 moves back and forth across the base 512 to deposit ink onto the substrate 599. According to these embodiments, the print heads 501, 502, 503, and 504 deposit ink on the substrate 599 as it moves across the rail system 516. Shortly after depositing ink, a rotating rod (528 or 529, depending on the direction of the carriage) encounters the ink droplet. The rotating rod 528 or 529 passes over the ink droplet, thus applying pressure to the droplet and isolating a portion of the droplet from atmosphere. The isolation of the droplet from atmosphere creates a momentarily oxygen-free curing environment. At that time ultraviolet light is directed to the isolated droplet, thus curing the ink.

In some embodiments, the vertical position of the substrate 599 is adjustable such that the amount of pressure applied to ink droplets by the rotating rods 528 and 529 can vary. According to these embodiments, the rotating rods 528 and 529 apply pressure to the ink droplet, thus affecting surface appearance and dot gain as explained above. Also, since the rotating rods 528 and 529 rotate at a rate that corresponds with that of the carriage 518, they tend not to drag or plow the ink droplet.

The rotating rods 528 and 529 are substantially transparent to at least a portion of the ultraviolet spectrum of light. In one embodiment of the invention, the rotating rods 528 and 529 are quartz, however it will be readily apparent to those with ordinary skill in the relevant art having the benefit of this disclosure that any suitable material can be used that is substantially transparent to at least part of the ultraviolet spectrum.

Figure 6A:
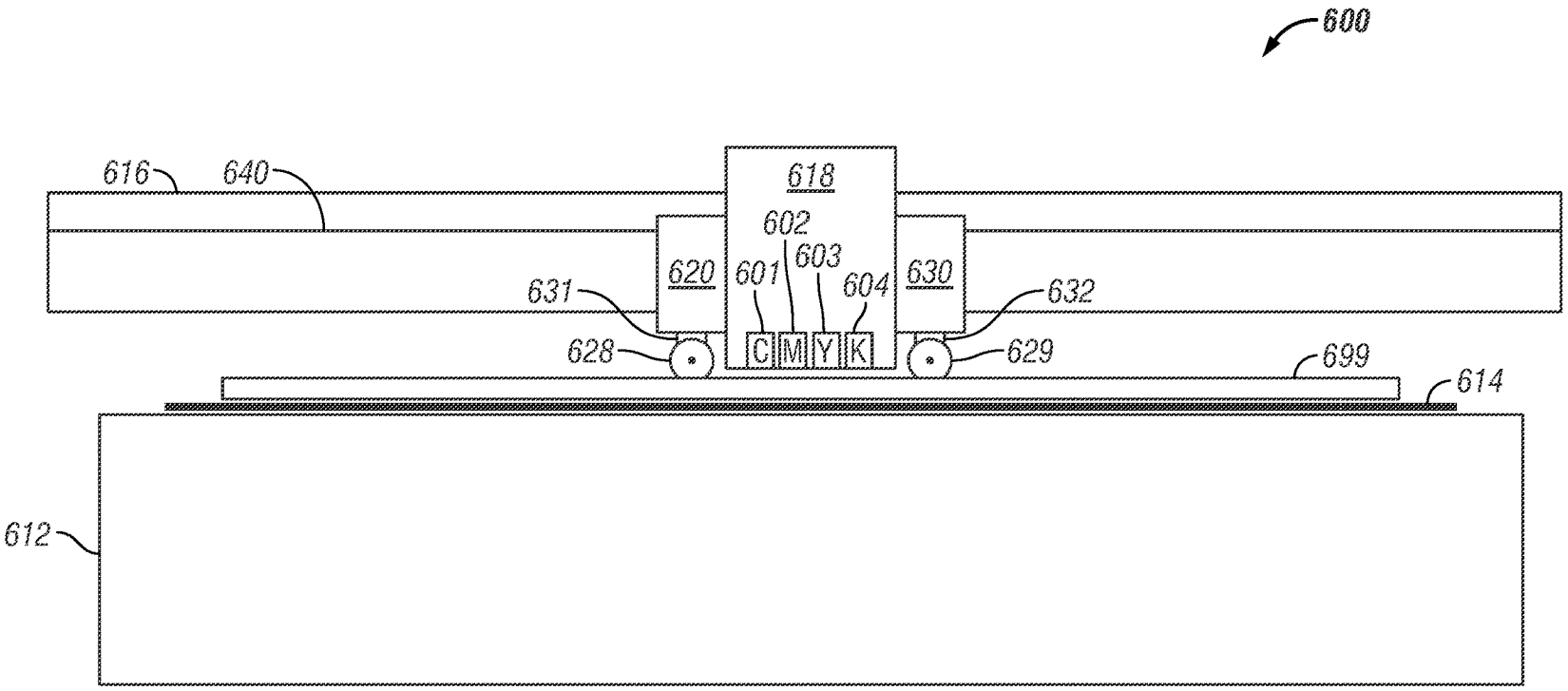
FIG. 6A is a front view of a printing system that includes a reduced oxygen curing region, according to some embodiments of the invention.

FIG. 6A is a front view of another printing system 600 that provides a less reactive curing area for inkjet printers according to some embodiments of the invention. FIG. 6A represents a modified version of the printing system 500 disclosed above. Specifically, flexible rotating cylinders 628 and 629 are used, as opposed to rotating rods.

Similar to the printer system 500 of FIG. 5, the printer 600 includes a carriage 618 containing print heads 601, 602, 603, and 604. The carriage 618 is coupled to the base 612 of the printer 600 via the rail system 616. The rail system 616 includes a belt 640 for moving the carriage 618 back and forth across the base 612. Also, a transport belt 614 is disposed on the surface of the base 612, and a substrate 699 is arranged between the carriage 618 and the transport belt 614. In operation, the transport belt 614 steps forward and/or backwards, as explained above, thus moving the substrate 699 in and/or out of the page.

The carriage 618 is also coupled to the ultraviolet light sources 620 and 630. The ultraviolet light sources 620 and 630 are coupled to arms 631 and 632, respectively. The arms 631 and 632 are coupled to flexible rotating cylinders 628 and 629 by a substantially axial member.

The carriage 618 moves back and forth across the base 612 to deposit ink onto the substrate 699. According to these embodiments, the print heads 601, 602, 603, and 604 deposit ink on the substrate 699 as it moves across the rail system 616. Shortly after depositing ink, a flexible rotating cylinder (628 or 629, depending on the direction of the carriage) encounters the ink droplet. The flexible rotating cylinder 628 or 629 passes over the ink droplet, thus applying pressure to the droplet and isolating a portion of the droplets from atmosphere.

According to these embodiments, the surface area under the flexible rotating cylinders 628 and 629 is greater because the cylinders 628 and 629 are flattened due to their flexibility. The increased surface area increases the size of the portion of the droplets isolated from atmosphere. Therefore the reduced oxygen curing region is larger than would be available by using rigid cylinders. The isolation of the droplets from atmosphere creates a momentarily oxygen-reduced curing environment. At that time ultraviolet light is directed to the isolated droplets, thus curing the ink.

Figure 6B:
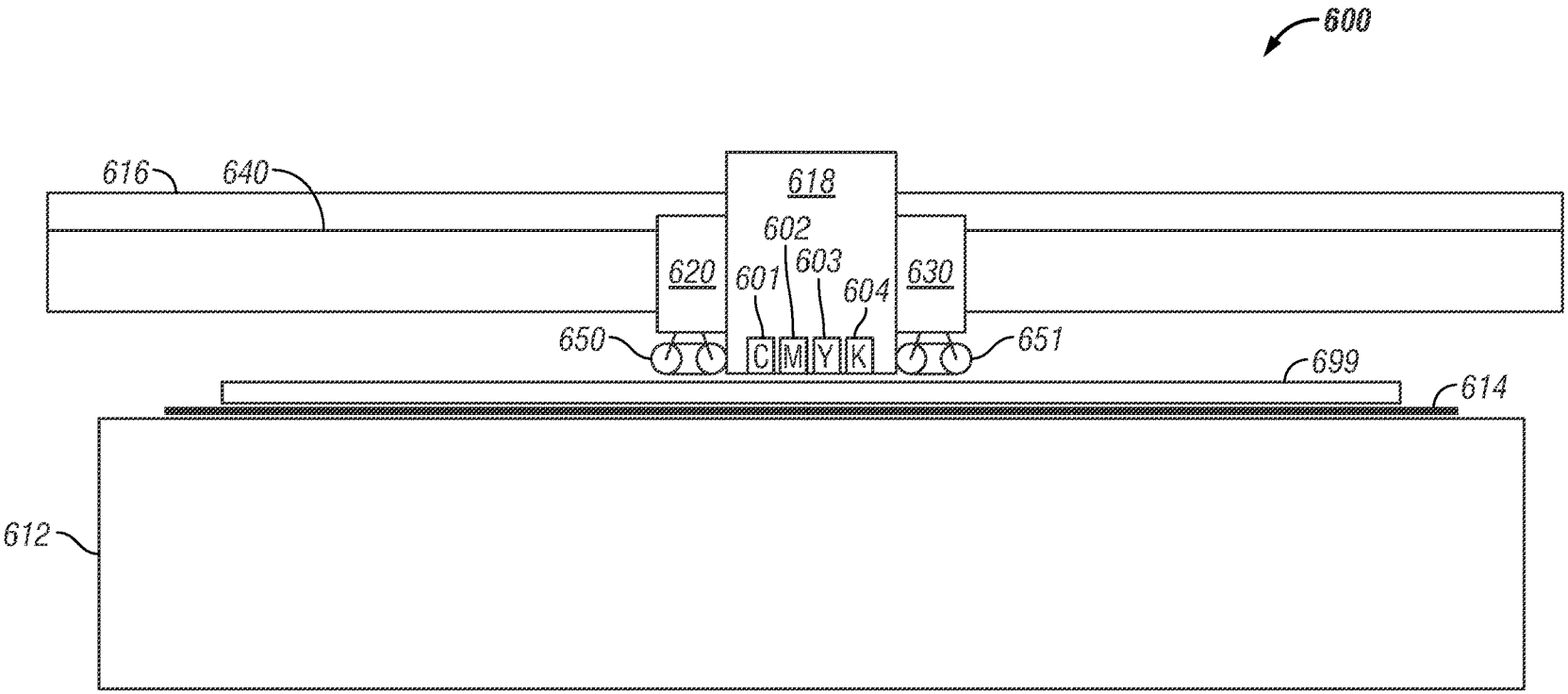
FIG. 6B is a front view of an alternative printing system that includes a reduced oxygen curing region, according to some embodiments of the invention.

FIG. 6B is a front view of a printing system for providing a reduced oxygen curing region in inkjet applications according to some embodiments of the invention. FIG. 6B represents the printing system 600 from FIG. 6A, with the addition of film-barrier rollers 650 and 651 replacing the flexible rotating cylinders.

The printing system 600 also includes a carriage 618 containing print heads 601, 602, 603, and 604. The carriage 618 is coupled to the base 612 of the printer 600 via the rail system 616. The rail system 616 includes a belt 640 for moving the carriage 618 back and forth across the base 612. Also, a transport belt 614 is disposed on the surface of the base 612, and a substrate 699 is arranged between the carriage 618 and the transport belt 614. In operation, the transport belt 614 steps forward and/or backward, as explained above, thus moving the substrate 699 in and/or out of the page.

The carriage 618 is also coupled to the ultraviolet light sources 620 and 630. The ultraviolet light sources 620 and 630 are coupled to film-barrier rollers 650 and 651, respectively. The film-barrier rollers 650 and 651 comprise two rotating guides having an ultraviolet transparent film strung around them. The film-barrier rollers 650 and 651 lay down a film upon ink droplets as the carriage 618 traverses the substrate 699. The film-barrier rollers 650 and 651 provide an increased area of contact between the film and the substrate 699.

Other Methods and Apparatus

Figure 7A:
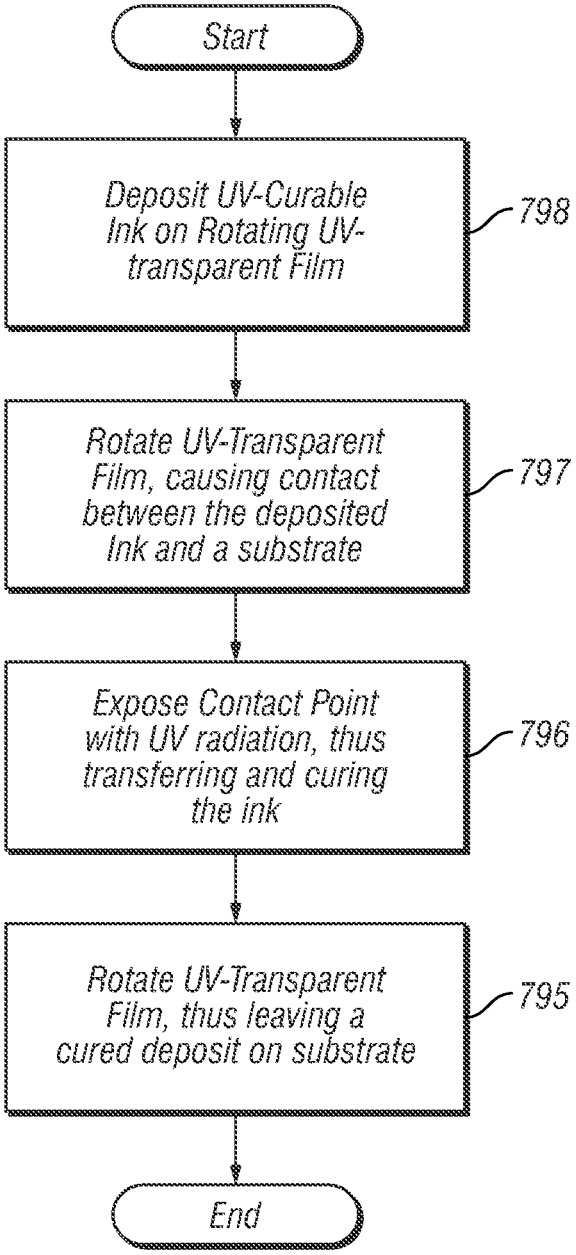
FIG. 7A illustrates another process for ultraviolet curing of deposited ink in an inkjet printing system, according to some embodiments of the invention.

FIG. 7A illustrates another process 700 for ultraviolet curing of deposited ink in an inkjet printing system, according to some embodiments of the invention. The process begins with depositing ultraviolet curable ink on a rotating UV-transparent film 798. The film is then rotated, causing contact to be made over a contact area between the deposited ink and a substrate 797. This contact area is exposed to ultraviolet radiation, thus transferring the ink to the substrate and substantially simultaneously curing the ink 796. Finally, the ultraviolet-transparent film is rotated further, thus removing the film from the contact point and leaving a cured ink deposit on the substrate 795.

Figure 7B:
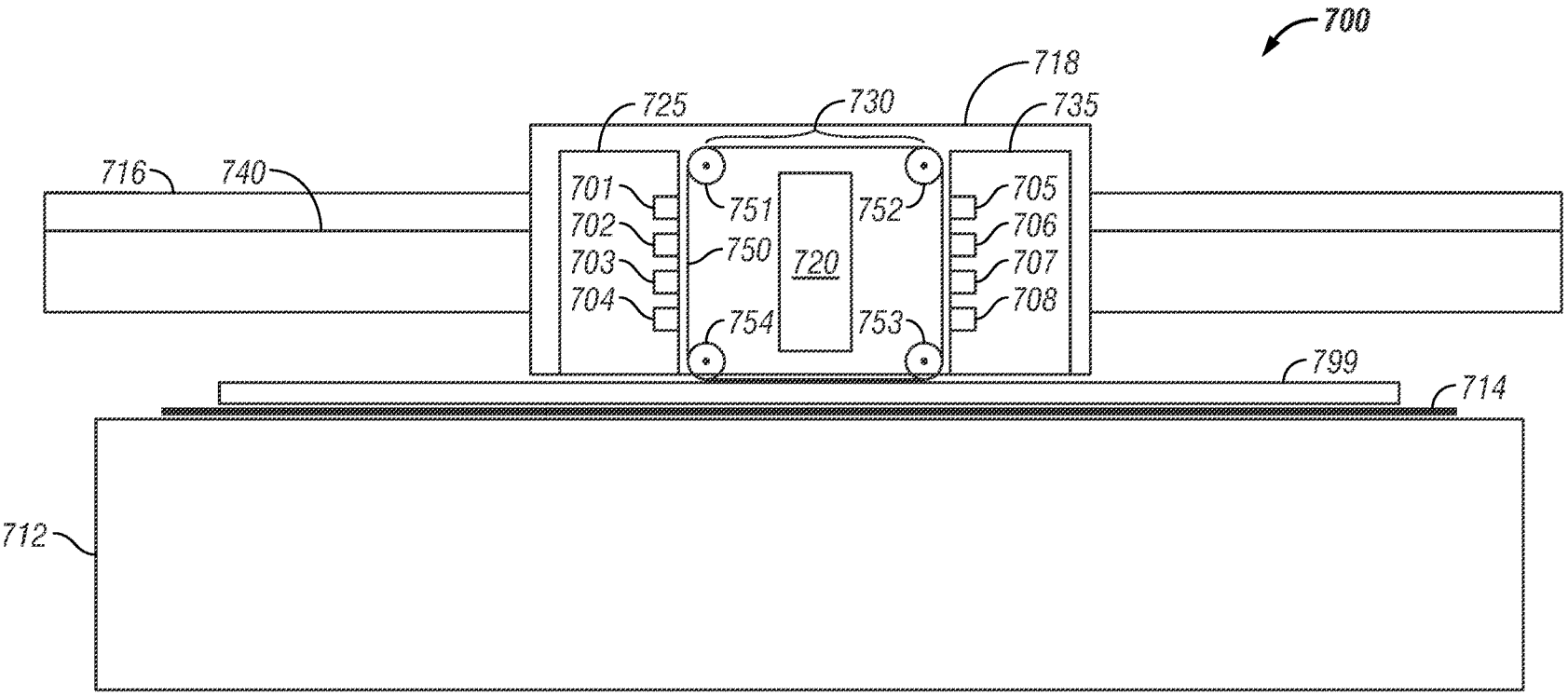
FIG. 7B is a front view of yet another embodiment of a printer system that includes a less reactive curing region, according to some embodiments of the invention.

In some embodiments of the invention, the method described in FIG. 7A is carried out using the system disclosed in FIG. 7B. FIG. 7B is a front view of yet another example of a printer system 700 that provides a less reactive curing region according to some embodiments of the invention. According to FIG. 7B, the printer system 700 includes a carriage 718 coupled to the printer 700. The carriage 718 is coupled to the base 712 of the printer 700 via the rail system 716. The rail system 716 includes a belt 740 for moving the carriage 718 back and forth across the base 712. Also, a transport belt 714 is disposed on the surface of the base 712, and a substrate 799 is arranged between the carriage 718 and the transport belt 714. In operation, the transport belt 714 steps forward and/or backwards, as explained above, thus moving the substrate 799 in and/or out of the page.

The carriage 718 contains two inkjet cartridges 725 and 735, one on either side of a barrier film assembly 730. The barrier film assembly 730 contains an ultraviolet light source 720. The inkjet cartridges 725 and 735 contain print heads 701, 702, 703, 704, 705, 706, 707, and 708. The barrier film assembly comprises the UV light source 720 surrounded by a film 750 supported by guides 751, 752, 753, and 754.

The carriage 718 moves back and forth across the base 712. As the carriage 718 traverses the substrate 799, the film 750 rotates around the guides 751, 752, 753, and 754. The print heads 701, 702, 703, 704, 705, 706, 707, and 708 deposit droplets of ink on the film 750. Accordingly, the droplets make contact with the substrate 799 when it rotates under the guides 753 or 754 (depending on the direction of motion). When the ink contacts the substrate 799 it is transferred to the substrate 799 and cured simultaneously or nearly simultaneously by the UV light source 720 passing nearby or directly over the transferred ink.

Figure 8:
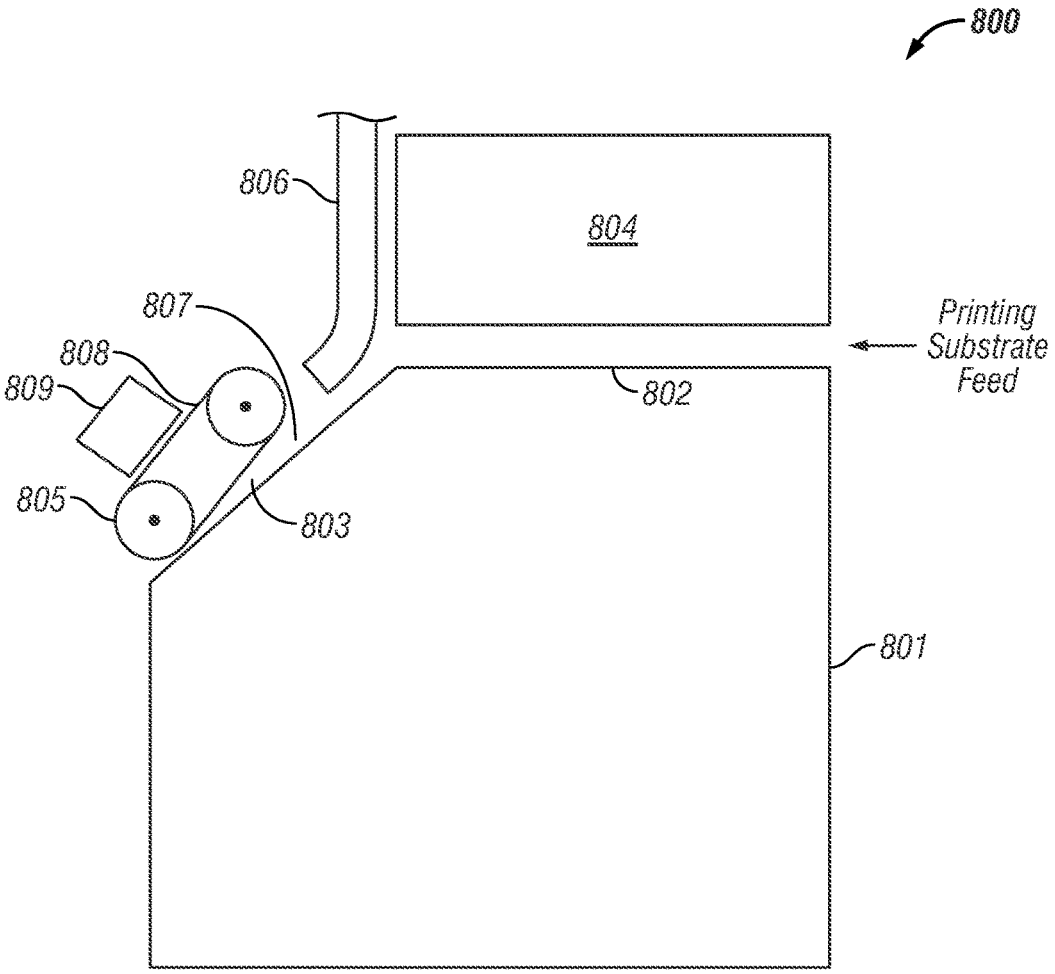
FIG. 8 illustrates a side view of a printing system with a reduced oxygen curing region using an atmospheric-barrier film and incorporating less reactive gas introduction, according to some other embodiments of the invention.

FIG. 8 illustrates a side view of a printing system 800 with a reduced oxygen curing region accomplished by using atmospheric-barrier films, and incorporating less reactive gas introduction according to some embodiments of the invention. The printing system 800 includes a printer base 801 with a printing region 802 and a curing region 803. A carriage 804 containing print heads is disposed above the printing region 802. The carriage 804 traverses the printing region 802, in and out of the page, as a substrate (not shown) is introduced to the printing system 800 as indicated by the arrow. In some embodiments, the substrate is moved through the printing system 800 with a transport belt (not shown). The carriage 804 deposits UV curable ink onto the substrate as it passes underneath the carriage 804. In some embodiments, the carriage 804 can extend the full width of the printing system 800. In other embodiments, the carriage 804 is configured to traverse the width of the printing area 802.

After the substrate receives ink droplets from the carriage 804, it continues into the curing region 803, which includes a roller system 805; a less-reactive gas introduction means 806; a less reactive gas pocket 807; and a UV light source 809.

The curing region 803 comprises a roller system 805 for the application of an atmospheric-barrier film 808 to a substrate, as well as less reactive gas introduction means 806. In some embodiments, the roller system is disposed at an angle to the surface of the curing region 803, thus forming a pocket 807. The less reactive gas introduction means 806 is configured to deliver less reactive gas into the pocket 807.

In some embodiments of the invention, the roller system 805 extends the full width of the printing system 800. Likewise, in some embodiments, the UV light source 809 can extend the full width of the printing system 800. In some other embodiments, the UV light source 809 is coupled to the printing system 800, and configured to traverse the curing area 803 in concert with the carriage 804.

In some embodiments of the invention, the printing system 800 can include a dual-mode curing station to cure the ultraviolet-curable ink onto the substrate, the dual-mode curing station operable in a first mode and a second mode, the first mode producing a matte finish, and the second mode producing a glossy finish. The printing system 800, with a reduced oxygen curing region using atmospheric-barrier films and incorporating less reactive gas introduction, is used by choosing either the barrier film application or less reactive gas introduction in a given application. For instance, in applications demanding a matte finish, the application of barrier film will smooth out the peaks and valleys, as explained above. Therefore, according to these embodiments, a gas introduction method is desired over the barrier film application. Likewise, the barrier film application can be chosen over the gas introduction methods.

In other embodiments, both the barrier film application and the gas introduction methods are used together. According to these embodiments, a substrate is fed through the printing region 802, and UV-curable ink is deposited onto the substrate. It is then fed into the curing region 803, thus encountering the less reactive gas. Subsequently, the substrate makes contact with the atmospheric-barrier film 808. The less reactive gas and the atmospheric-barrier film 808 work synergistically to reduce the possibility of oxygen reacting with the ink during curing. Furthermore, the film barrier 808 applies pressure to the ink droplets, thus increasing coverage and altering surface appearance, as explained above.

In some embodiments, the roller system 805 begins at an angle to the curing region 803, thus forming the less reactive gas pocket 807, and rotates down to contact the substrate for curing. In any event, the "downstream" roller in the roller system 805 consistently makes contact with substrate that is passing through.

In some cases of UV inkjet printing, the UV light source is a low power UV source, sufficient to only partially cure the ink. This practice is known as pinning because it prevents movement of the ink droplets, but does not fully cure them. In these cases, a full cure is oftentimes performed after the image is completely printed. In some embodiments, a low power UV lamp (not shown) is additionally included upstream from the curing region 803 to "pin" the ink droplets before a full cure.

The covered and less reactive gas exposed substrate is then exposed to UV radiation from the light source 809, thus curing the ink. The substrate continues past the roller system 805 and the film barrier 808 is removed, leaving cured ink on the substrate.

It will be readily apparent to those with ordinary skill in the relevant art will having the benefit of this disclosure that in other embodiments, electromagnetic radiation at other ranges of wavelengths can be used to cure ink. According to these embodiments, the barrier used is substantially transparent to those ranges of wavelengths.

As will be understood by those familiar with the art, the invention may be embodied in other specific forms without departing from the spirit or essential characteristics thereof. Likewise, the particular naming and division of the members, features, attributes, and other aspects are not mandatory or significant, and the mechanisms that implement the invention or its features may have different names, divisions and/or formats. Accordingly, the disclosure of the invention is intended to be illustrative, but not limiting, of the scope of the invention, which is set forth in the following Claims.

The invention claimed is:

1. A system comprising:

a print head for depositing ultraviolet-curable ink onto a substrate; and a dual-mode curing station to cure the ultraviolet-curable ink onto the substrate, the dual-mode curing station operable in a first mode and a second mode, the first mode producing a matte finish, and the second mode producing a glossy finish, the first mode comprising a plurality of rollers supporting an atmospheric barrier film and applying the atmospheric barrier film at an angle to the substrate forming a pocket in which to introduce a gas, the atmospheric barrier film substantially preventing oxygen from entering the pocket, the second mode comprising the plurality of rollers supporting the atmospheric barrier film and applying the atmospheric barrier film substantially parallel to the substrate.

2. The system of claim 1, each roller in the plurality of rollers individually movable to create the pocket between the atmospheric barrier film and the substrate, and to apply to the atmospheric barrier film substantially parallel to the substrate.

3. The system of claim 1, the dual-mode curing station comprising a low-power ultraviolet (UV) light source consuming at most 15% of power consumed by a regular UV light source.

4. The system of claim 3, the low-power UV light source illuminating the ultraviolet-curable ink through the atmospheric barrier film.

5. The system of claim 3, the low-power UV light source extending along full width of a printing area associated with the substrate.

6. The system of claim 1, comprising a second low-power UV light source disposed between the print head and the dual-mode curing station, the second low-power UV light source pinning the ultraviolet-curable ink onto the substrate.

7. The system of claim 6, the second low-power UV light source directly illuminating the ultraviolet-curable ink.

8. The system of claim 1, the atmospheric barrier film comprising a film substantially transparent to ultraviolet energy.

9. The system of claim 1, the plurality of rollers supporting the atmospheric barrier film extending along full width of a printing area is associated with the substrate.

10. The system of claim 1, the gas comprising a gas last reactive with the ultraviolet-curable ink then oxygen.

11. A method comprising:

depositing an ultraviolet-curable ink onto a substrate;

receiving an input specifying a matte finish or a glossy finish;

in response to the input specifying the matte finish, curing the ultraviolet-curable ink by:

applying an atmospheric barrier film at an angle to the substrate to form a pocket in which to introduce a less reactive gas, the atmospheric barrier film substantially preventing oxygen from entering the pocket;

introducing the less reactive gas into the pocket, wherein the less reactive gas comprises a gas less reactive with the ultraviolet-curable ink than oxygen;

illuminating the ultraviolet-curable ink using an ultra violet (UV) light source;

in response to the input specifying the glossy finish, curing the ultraviolet-curable ink by:

applying a pressure to the ultraviolet-curable ink deposited on the substrate using the atmospheric barrier film disposed substantially parallel to the substrate; and illuminating the ultraviolet-curable ink using the UV light source.

12. The method of claim 11, comprising in response to the input specifying the glossy finish, said curing comprising:

applying the atmospheric barrier film at the angle to the substrate to form the pocket in which to introduce the less reactive gas, the atmospheric barrier film substantially preventing oxygen from entering the pocket;

introducing the less reactive gas into the pocket, wherein the less reactive gas comprises the gas less reactive with the ultraviolet-curable ink than oxygen;

applying the pressure to the ultraviolet-curable ink deposited on the substrate using the atmospheric barrier film disposed substantially parallel to the substrate; and illuminating the ultraviolet-curable ink using the UV light source.

13. The method of claim 11, comprising in response to the input specifying the matte finish, said curing comprising:

applying the pressure to the ultraviolet-curable ink deposited on the substrate using a textured film disposed substantially parallel to the substrate; and illuminating the ultraviolet-curable ink using the UV light source.

14. The method of claim 11, comprising reducing power consumption required in curing the ultraviolet-curable ink by at least 85%, said reducing comprising:

substantially removing oxygen between the atmospheric barrier film and the ultraviolet-curable ink deposited on the substrate; and illuminating the ultraviolet-curable ink with the UV light source through the atmospheric barrier film.

15. The method of claim 11, comprising:

prior to said curing, directly illuminating the ultraviolet-curable ink with a second low-power UV light source to pin the ultraviolet-curable ink onto the substrate.

16. A method comprising:

providing a print head for depositing ultraviolet-curable ink onto a substrate; and providing a dual-mode curing station to cure the ultraviolet-curable ink onto the substrate, the dual-mode curing station operable in a first mode and a second mode, the first mode producing a matte finish, and the second mode producing a glossy finish, the first mode comprising a plurality of rollers supporting an atmospheric barrier film and applying the atmospheric barrier film at an angle to the substrate forming a pocket in which to introduce a gas, the atmospheric barrier film substantially preventing oxygen from entering the pocket, the second mode comprising the plurality of rollers supporting the atmospheric barrier film and applying the atmospheric barrier film substantially parallel to the substrate.

17. The method of claim 16, providing the plurality of rollers wherein each roller in the plurality of rollers individually movable to create the pocket between the atmospheric barrier film and the substrate, and to apply to the atmospheric barrier film substantially parallel to the substrate.

18. The method of claim 16, providing a low-power ultraviolet (UV) light source consuming at most 15% of power consumed by a regular UV light source.

19. The method of claim 16, providing a second low-power UV light source disposed between the print head and the dual-mode curing station, the second low-power UV light source pinning the ultraviolet-curable ink onto the substrate.

20. The method of claim 16, providing the plurality of rollers supporting the atmospheric barrier film extending along full width of a printing area is associated with the substrate.

* * * * *